United States Patent [19]

Baugher

[11] Patent Number: 4,550,690

[45] Date of Patent: Nov. 5, 1985

[54] STEAM TUBE YOKE AND HANGER ASSEMBLY INSULATION COVER

[75] Inventor: Stuart W. Baugher, Bakersfield, Calif.

[73] Assignee: Chevron Research Company, San Francisco, Calif.

[21] Appl. No.: 672,626

[22] Filed: Nov. 19, 1984

[51] Int. Cl.[4] ..... F22B 37/24

[52] U.S. Cl. ..... 122/510; 122/511; 165/162; 248/49

[58] Field of Search ..... 122/510, 511, DIG. 13; 165/162; 248/49

[56] References Cited

U.S. PATENT DOCUMENTS

| | | | |
|---|---|---|---|
| 3,545,534 | 12/1970 | Coles et al. | 122/510 X |
| 4,019,468 | 4/1977 | Miles | 122/510 |
| 4,263,964 | 4/1981 | Masai et al. | 122/510 X |
| 4,485,766 | 12/1984 | Worley et al. | 122/510 |

*Primary Examiner*—Edward G. Favors

*Attorney, Agent, or Firm*—Burns, Doane, Swecker & Mathis

[57] ABSTRACT

A refractory cover for steam tube yokes and hangers may be assembled or disassembled from parallel steam pipes or tubes circumferentially distributed around a cylindrical steam boiler furnace. The yoke and hanger assemblies that support such steam tubes are protected against deterioration and mechanical failure due to thermal and combustion gas interaction with the supports. The cover includes an open box and an end closure having interlocking U-shaped openings that fit around the pipe and cover one side of the yoke and hanger. A lid member includes an outer and inner interlocking U-shaped openings at 90 degrees to the box and enclosure openings which also fit around the pipe to cover the other side of the yoke and hanger. In a preferred form the box bottom includes a pair of parallel U-shaped openings to span a yoke and hanger which supports adjacent parallel steam pipes.

7 Claims, 8 Drawing Figures

STEAM TUBE YOKE AND HANGER ASSEMBLY INSULATION COVER

FIELD OF THE INVENTION

The present invention relates to insulation covers and a method of installing such covers for boiler steam tube support assemblies. More particularly, it relates to a method of insulating and protecting yoke and hanger assemblies used to support a plurality of parallel steam tubes distributed around the circumference of an elongated cylindrical furnace, such as a "once through" steam generator, used for steam enhanced, or assisted, recovery of petroleum from underground formations.

It is a particular object of the present invention to provide a yoke and hanger cover assembly which may be installed without disassembly of the steam tubes from such supports in the generator or "boiler". In accordance with the invention, a cover assembly for the yoke and hanger assembly is provided by a box member, open at the top and one end, and having a U-shaped opening in the box bottom to fit around half of at least one steam tube, and preferably two, and around a yoke affixed to a support hanger. A multiplicity of these hangers circumferentially space a plurality of axially parallel steam tubes around the periphery of a large cylindrical furnace or convection section, of the steam generator. An end closure nests within the box bottom U-shaped opening to enclose completely the steam tube, or tubes, and interlocks with the box bottom. The box and end closure then slips or slides axially along the steam pipe to cover one face, the sides of the yoke and at least a portion of the hanger. A cover member is then assembled to the box on the opposite face of the yoke and hanger to enclose them. The cover member includes a U-shaped opening to fit around a steam pipe; the opening is generally at a right angle to the U-shaped opening in the box bottom and includes a nesting second part which slides into the U-shaped cover opening to enclose the steam tube. The cover is then secured to the assembled box bottom and end enclosure so that the cover assembly surrounds the yoke and at least a portion of the hanger.

The arrangement protects the yoke and hanger from radiant heat from the burner flame and combustion gases required to generate steam within the steam tubes or pipes. The insulation box and cover are formed of high temperature, corrosion resistant refractory materials and are essentially free-floating both on the tubes and around the yoke and hanger assembly. Thus, differences in thermal expansion of the yoke, hanger and pipe with respect to insulating material does not result in cracking, abrasion or premature deterioration of the support means for the steam tubes. Further, the cover assembly reduces heat loss from the furnace wall through the yoke and hanger assembly.

BACKGROUND OF THE INVENTION

Enhanced or assisted oil recovery from underground petroleum bearing formations has become a widely practiced technique for extracting a greater percentage of available hydrocarbons from such formations. In present-day practice, steam injection to enhance such recovery is one of the most successful commercial methods. In general the method involves heating water after it has been properly softened, as by treatment in an ion exchanger, in a single-pass steam generator to generate a "low quality" steam (i.e. steam containing a water phase). The resulting steam is then supplied to the earth formation for either stimulating a single well or injected into one well or a plurality of wells as heat and hydraulic pressure to drive oil from the steam injection well to one or more producing wells.

In the production of such steam it is desirable to use any field available hydrocarbons. Frequently a portion of the oil recovered in the oil field is used, rather than fuel transported from a refinery. Where such fuel is available from a refinery, it is generally of a lower quality and frequently contains materials such as sulfur, vanadium and the like which tend to generate corrosion products during combustion. Even with relatively high quality heating fuels, the products of combustion of such fuel may generate corrosion products, particularly in combination with ever present water vapor produced by such combustion. Hence, steam pipes and their support arrangements are subject not only to high temperatures necessary to quickly generate steam in a single, or limited pass, radiant heat section, but also to attack by corrosive combustion products.

A particular form of vapor generator, widely used in enhanced oil recovery, comprises a horizontally elongated furnace having a convection section formed by a horizontal cylindrical shell of substantial diameter, say 8 to 10 feet. The shell supports one or more serpentine coils of pipe formed by running multiple courses of pipes axially parallel to and equally spaced around the circumference of the shell. Steam is generated by water passing through the "coil" formed by U-turns between the pipes at both ends of the cylinder. The cylinder may be on the order of 40 feet in length. The pipes, which may be from 1 to 4 inches in diameter, must be supported radially inwardly from the inner circumference of the cylinder by a plurality of hangers and yokes to provide a stand-off between the steam pipes and the inner wall of the cylinder, including its insulated inner refractory surface, formed by fire brick, or cast.

While in general it is desirable to use a relatively light yoke to avoid loss of heat from it to the shell supported hanger, the size of such yokes has increased progressively to withstand deterioration by corrosion and heat. Attempts have been made to stop such deterioration of the yokes by packing them with insulating material, including casting or wiring (or both) the insulation in place. However, oxidation of parts of the yoke results in the pack not adhering to it over extended operating times. Loss of insulation, of course, results in higher operating costs due to loss of heat through the hanger connection to the outside wall. Further, casting or forming heat resistant coatings around each of several hundred yokes is expensive, both to install and to maintain.

Another solution proposed for such deterioration has been to use more sophisticated steel metallurgy for both the yokes and hangers. Such steels are considerably more expensive than insulated conventional steels if properly insulated. Further, presently operating furnaces could be so retrofitted only by complete reconstruction.

While it is known to use insulating shields or covers for steam tubes or pipes in furnaces and steam generators, such shields are in general intended to be installed permenantly so as to serve as primary supports between tubes. Such shielding means have not been designed for installation or replacement as a field retrofit around existing supports for horizontal, circumferentially distributed, steam generator tubes. For example, U.S. Pat. No. 3,277,872-Hoffmann et al, No. 2,859,737-Banker, No. 2,983,261-Nelson, and No. 3164137-Liessenberg, each disclose shielding arrangements for boiler tubes. However, zone discloses or suggests a replaceable, or retrofit, installation for shielding yokes and hangers to support circumferentially distributed steam tubes that axially extend parallel along the length of a cylindrical steam generator so that they may be serially connected by return loops.

SUMMARY OF THE INVENTION

In a preferred form of the invention, a replaceable refractory cover member is formed to enclose a yoke and at least a portion of a hanger means. Such yoke and hanger means support each of a multiplicity of steam tubes substantially equally spaced apart around the inner circumferential surface of a cylindrical shell or housing to form a conduction heating section of a steam generator furnace. The pipes extend axially through the cylindrical shell and each pipe is connected in series by U-turns to form a single-pass steam generator suitable for supplying steam for injection into an underground formation to enhance oil recovery. Such cover member may be installed or removed, without disassembly of the yoke and hanger means from the steam tubes.

A preferred embodiment of the cover member includes a box member open at the top and one end with the base of the box having at least one U-shaped opening to engage closely or frictionally one or more of the pipes or tubes with the base abutting one side of both the yoke and a portion of said hanger. The sides of the box are formed to then extend axially along the pipe member and across the axial thickness of the yoke and hanger means. An end closure member nests between the open end of the box and lies on the same side of the yoke and hanger means. It includes a U-shaped opening adapted to slidably interlock with the U-shaped opening in the box base to cover the diametrically opposed portion of the steam tube.

A lid or enclosing member covers the open box member and includes a pair of nesting elements. Each element has a U-shaped opening for slidably engaging a steam tube on the opposite side of the yoke and hanger members, with the U-shaped openings surrounding diametrically opposed portions of the steam tube. Preferably, both U-shaped openings are at right angles to the U-shaped openings in the box base and end closure.

The assembled box member and cover member enclose the support yoke and at least a portion of the hanger, as well as a portion of the steam tube extending therethrough. Means, such as a single nut and bolt, secure the lid member to the box member and clamp the inner lid piece and end enclosure therebetween.

The arrangement reduces the loss of heat from the steam tubes and the combustion chamber through the yoke and hanger to the furnace shell. While such assembly is particularly useful for retrofitting such supports with thermal insulaton, it also permits the construction of such generators with less massive (and less heat absorbing) yokes and hangers and without resort to high cost metals resistant to corrosion and heat.

In a preferred method of enclosing the yoke and hanger and a portion of the pipe or tubing supported thereby, the box member is pushed radially outwardly over the pipe so that the U-shaped opening therein surrounds the inner half of the pipe, but at a location axially away from the yoke and hanger. The end closure is then pushed radially inwardly over the outer half of the pipe between the base and the yoke and then axially along the pipe into engagement within the box member. The assembly of box and end members then slides along the pipe to cover one side and the radially inward exposed edges of the yoke and hanger. The lid or top member is then assembled on the opposite side of the yoke and over the pipe section axially away from the box and end members, with their U-shaped openings in the complementary lid portions enclosing opposite sides of the pipe and with such openings at 90 degrees to the openings in the box and end members. The lid assembly then slides axially along the pipe and the cover assembly is secured to the box and end members to enclose the yoke and hanger.

Further objects and advantages to the present invention will become apparent from the following detailed description of the preferred embodiments of the invention taken in conjunction with the accompanying drawings which are an integral part of this specification.

DESCRIPTION OF THE PREFERRED EMBODIMENTS

Figure 1:
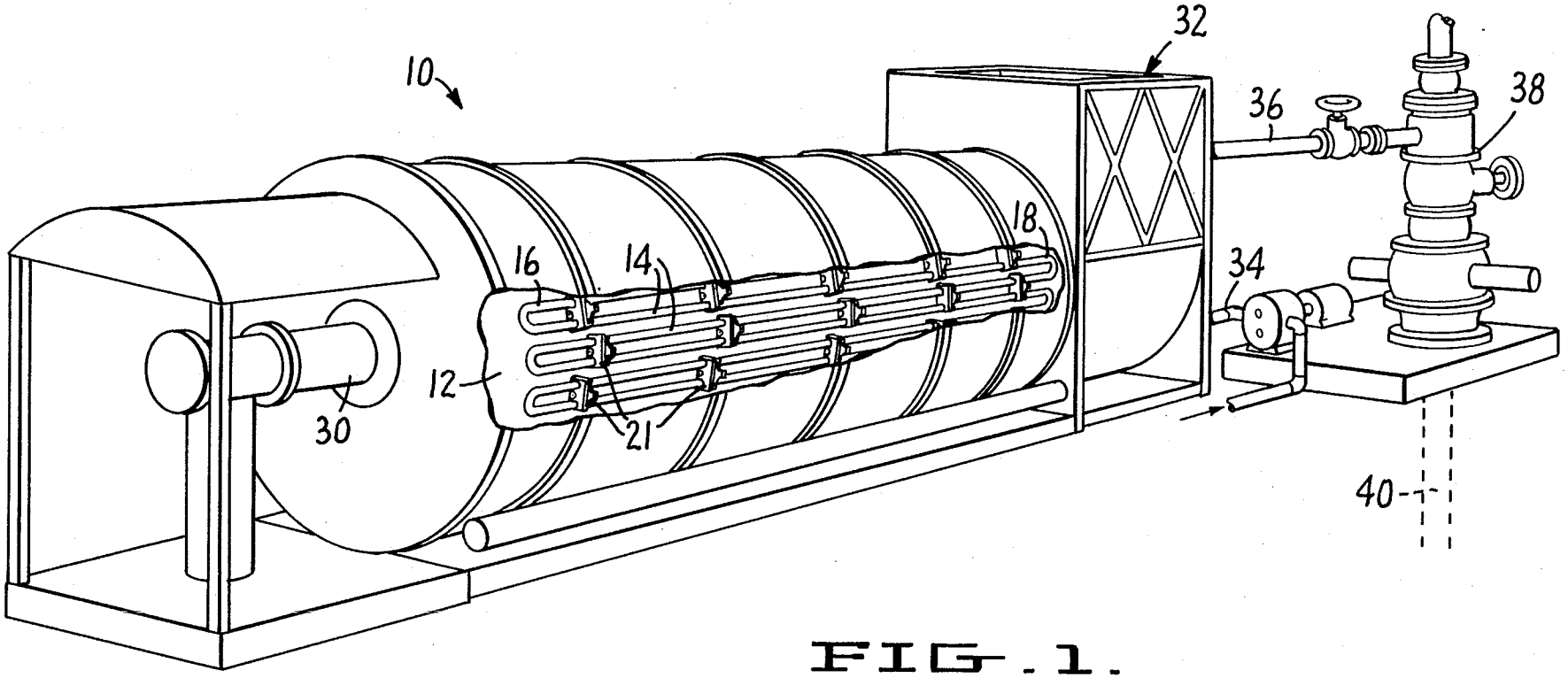
FIG. 1 is a perspective view of a singlepass steam generator of the type commonly used to generate low-quality steam by flow of water and generated steam through a multiplicity of axially parallel steam tubes around the inner circumference of a horizontal, cylindrical steam generator shell. Such tubes are supported by yokes and hangers to which the present invention has been applied.

Referring now to the drawings, and in particular to FIG. 1, steam generator 10 is of the type frequently used for generating low quality, that is, non-superheated steam, for injection into an underground oil field, either for stimulation of a single well or for steam drive to enhance recovery of oil from an underground formation. As shown, steam generator 10 includes a horizontally elongated cylindrical combustion chamber 12 for heating fluid in a multiplicity of steam tubes or pipes 14. These tubes are equally spaced circumferentially and radially inwardly, from the perimeter of the cylindrical housing. As indicated, adjacent runs of tubes 14 are connected in serpentine manner by U-turns 16 and 18 at the ends of the combustion chamber 12 so that water is heated in a single or a few separate passes through the serpentine connected tubes. Typically cylinder 12 may be eight to ten feet in diameter and the number of individual parallel courses of pipes 14 may be from 50 to 100, say, 60. Chamber 12 may be on the order of 40 feet long and accordingly it is necessary to support the pipes at several positions along the axial length of each course, say five or six rings of supports.

Figure 2:
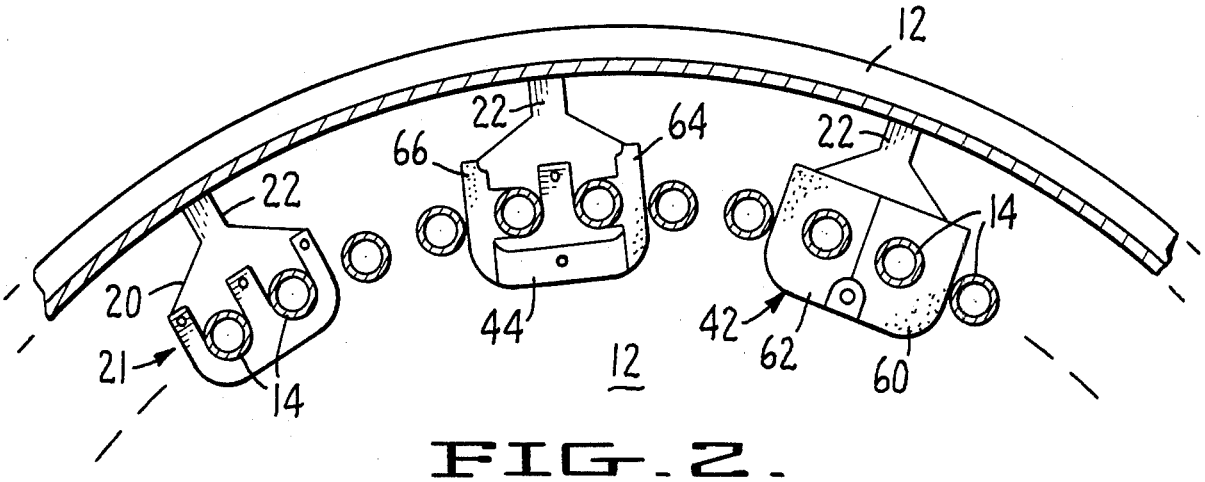
FIG. 2 is a partial cross-sectional view through the upper portion of the steam generator shell of FIG. 1 illustrating support of the parallel steam tubes by yoke and hanger arrangements. It particularly illustrates application of field or retrofit of the heat shielding arrangement of the present invention to protect such yoke and hanger supports without disassembly of the steam tubes from such supports.

As discussed above, each pipe 14 is supported by shell 12 on a tube and hanger assembly 21. As best seen in FIG. 2, assembly 21 includes hangers 20 connected to the outer wall of chamber 12 as by welding or the like through a reduced area flange 22. Pipes 14 are then supported on hanger 20 by yoke 24 which is preferably welded, bolted or riveted, as by three rivets or bolts 26 to hanger 20. In the present embodiment the hanger and yoke assembly is arranged to support two parallel pipes. However, it will be understood that individual hanger and yoke assemblies may be used for each pipe, or the hanger and yoke assembly may support more than two pipes. While the pipes and supports shown in FIG. 2 load top hangers 20 in tension, due to the suspended weight of the pipes, it will be apparent that those at the bottom of cylinder 12 will load the hanger in compression. In each case, yokes 24 act as spacers and prevent buckling or lateral movement of pipes 14 due to differences in thermal expansion of the tubes and the supports or furnace dimensions.

Combustion chamber 12 acts as a convection section for heating water and vaporized steam flowing through the tubes. Such fluid is heated during multiple passes through tubes 14 by combustion of oil or gas in burner 30 and flow of the combustion products through the center of the furnace or combustion chamber, 12. Heat in the combustion gases leaving furnace 12 is recovered from the exhaust gases by passing them through a preheater, or economizer 32 directly connected to the right-hand end of chamber 12. Water is supplied by line 34 to the economizer or preheater before it flows to the serpentine course of pipes 14 in chamber 12. Generated steam is supplied by insulated line 36 to well head 38 for injection into well 40 for flow to an underground formation.

As discussed above, direct exposure of pipes 14 and hanger and yoke assemblies 21, subjects them to intense heating, on the order of 2500° to 3000° F., as well as corrosion by the combustion products such as CO, $CO_2$, $SO_2$ and water vapor created by the burning hydrocarbons, whether gas or oil. Such corrosion is greatest on the hangers and yokes because there is no direct contact, as in the pipes 14, by fluid absorbing the heat. Further, such yoke and hanger assemblies are heated in different amounts depending on their relative locations around the perimiter of chamber 12 and the flow pattern of the combustion gases. Such differences in heating result in different thermal expansion and stresses on the yokes and hangers, as well as the pipes so supported.

While not shown in FIG. 2, it will be understood that where pipes 14 are spaced closely around the perimeter, it is common, as in FIG. 1, to stagger support assemblies 21 axially around each pair of pipes. That is, intermediate pairs of pipes, shown as not being supported, are, in fact, supported in a plane parallel to, but in front or in back of, the supports shown in FIG. 2. In this way the supports do not interfere with adjacent hangers and yokes and thereby permit their cover assemblies to be installed without difficulty.

Figure 3:
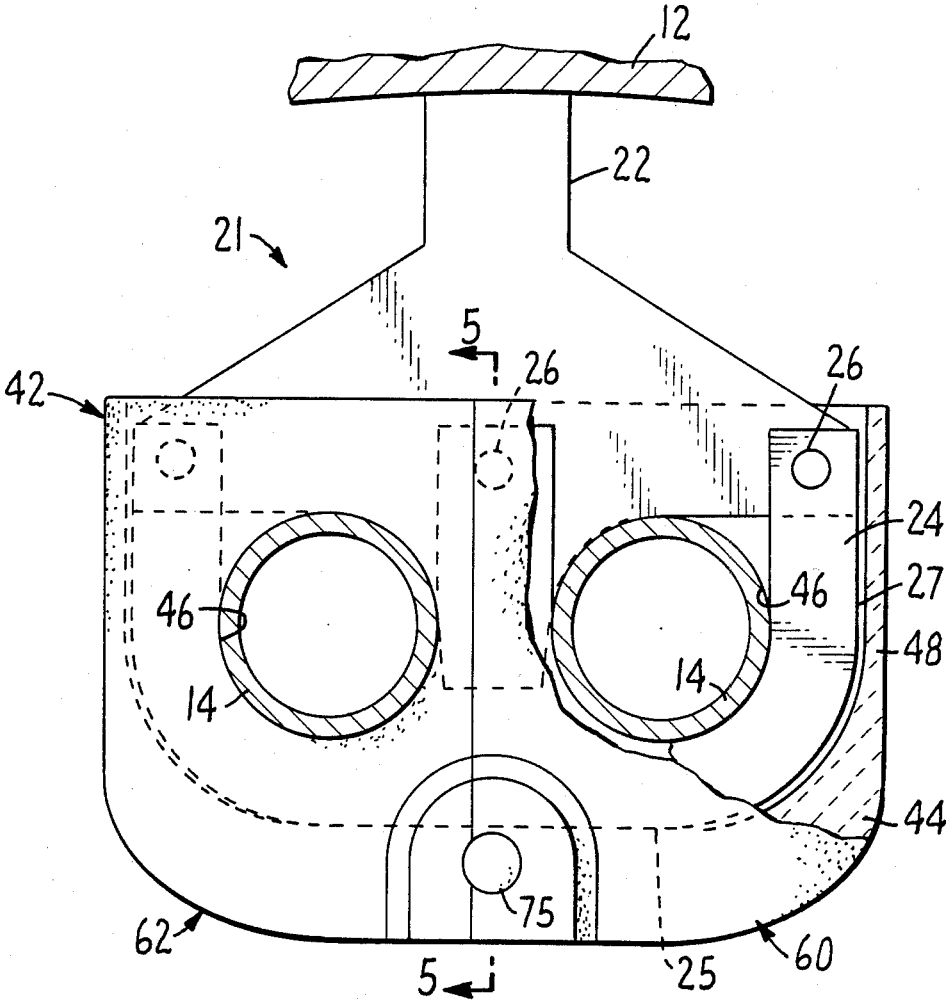
FIG. 3 is an enlarged cross-sectional view through a pair of steam tubes, as shown in FIGS. 1 and 2, with the heat and corrosion shield or cover arrangement around the yoke and hanger. The insulation, or shield box is shown, partially in cross-section, in plan view from the cover member side of the yoke and hanger insulation cover.
Figure 4:
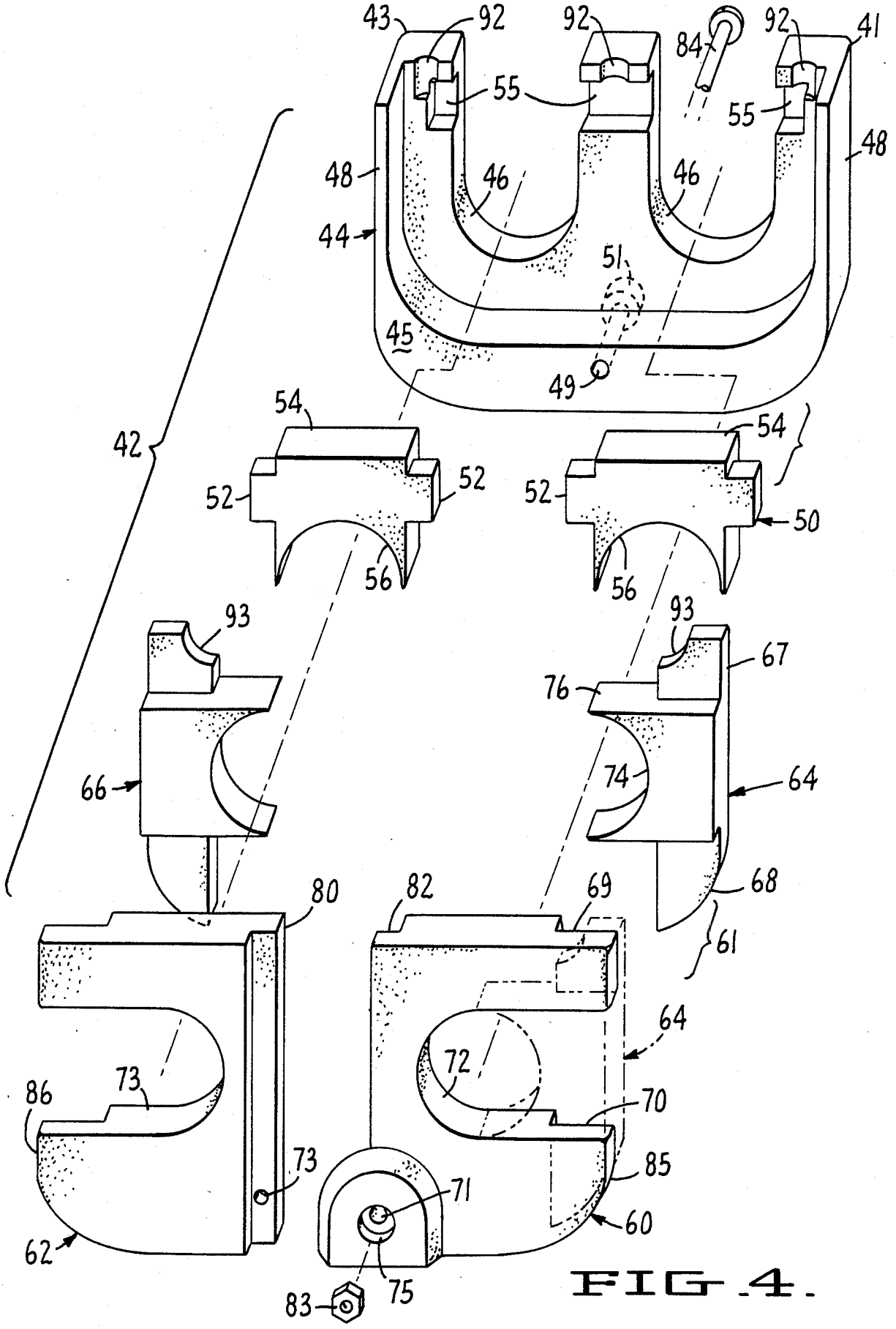
FIG. 4 is an exploded view of the elements of the yoke and hanger shield cover or box assembly particularly illustrating interconnection between seven elements of a preferred form of the invention to enclose a pair of steam tubes and the yoke and hanger support for such pair. This view also indicates in phantom, the interconnection of the two portions forming the lid or top assembly as well as that between the end closure member and the base or bottom of the open box member.
Figure 8:
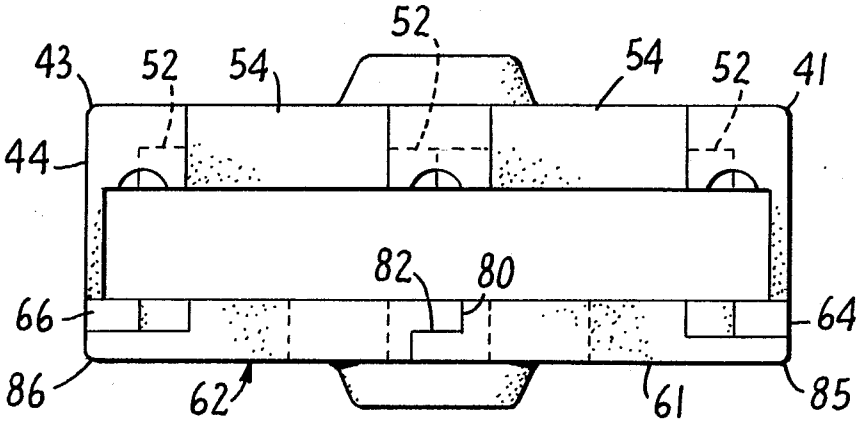
FIG. 8 is a top plan view of the replaceable insulation shield cover or box assembly prior to mounting around a yoke and hanger assembly.

As best seen in FIG. 3, the primary covering for yoke and hanger assemblies 21 is a box member 42 having a base or bottom 44 with a pair of U-shaped openings 46 formed therein. FIG. 4 shows in perspective that openings 46 engage the lower, or radially inner, half of the circumference of each pipe 14. Side sections 48 of box 42 generally surround the edges or thickness of yoke 24 and desirably extend around the inner end 25 and sides 27 of yoke 24. Preferably, it also extends radially outwardly beyond at least the abutment between yoke 24 and hanger 20 so that it covers rivets 26, as indicated in FIG. 3.

Figure 7:
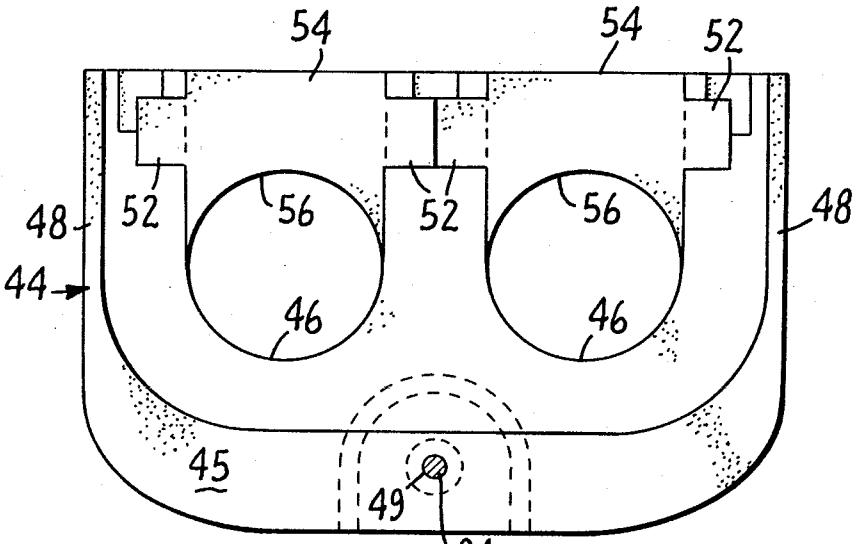
FIG. 7 is a similar view taken in the direction of arrows 7—7 in FIG. 5, illustrating in plan view the interconnection of the end closure and the box member base before assembly over a pair of pipes to surround the yoke and hanger assembly.
Figure 5:
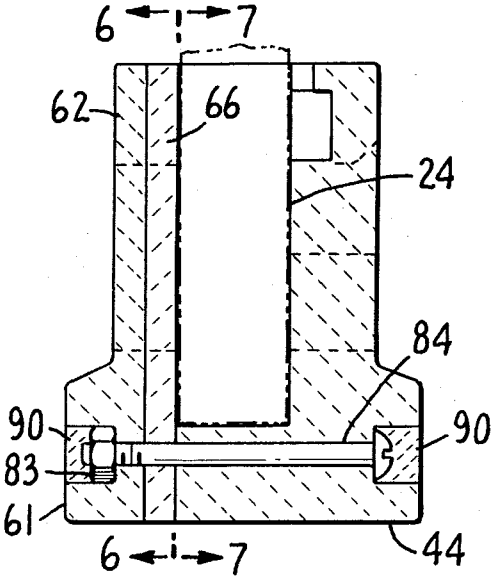
FIG. 5 is an elevation cross-sectional view in the direction of arrows 5—5 in FIG. 3, through the box assembly.

A pair of end closure members 50 mate with U-shaped openings 46 of base 44 so that complementary U-shaped opening 56 in body portion 54 of members 50 each completely enclose a steam pipe. Members 50 include a pair of locking tabs 52 laterally projecting from body portion 54, which mate with key-ways, or recesses, 55 formed in base 44. As shown in FIG. 7, portion 54 slides radially inwardly around a pipe so that U-shaped opening 56 is aligned with U-shaped opening 46 of base 44. Members 50 may then slide axially along one of the pipes to fit tabs 52 into keyways 55. With tabs 52 interlocked in recesses 55, the two U-shaped openings mutually surround steam pipe 14.

In assembly of end closure 50 with box bottom 44, as indicated above, box member 42 slides up, or radially outwardly, relative to pipes 14 and axially along pipes 14 so that base 44 is lateral away from yoke and hanger assembly 21. End closures 50 then slide inwardly over pipe 14 and axially along the pipes to engage tabs 52 with recesses or slots 55. The assembled base and end closure are then moved axially along the pipes to abut one face of a yoke and hanger assembly 21. As indicated in FIGS. 1 and 2, the accurate width of box member 42 is desirably substantially the circumferential distance between the next adjacent pipes 14 lateral to each yoke assembly, with an allowance of say $\frac{1}{8}$ inch for thermal expansion between the cover and such adjacent pipes.

The retrofit corrosion resistant cover assembly is then completed by engaging lid assembly 61 with the other side of yoke and hanger assembly 21. In the preferred embodiment shown in the drawings, lid assembly 61 comprises complementary outer portions 60 and 62, which respectively interlock with, inner elements 64 and 66. As indicated in FIG. 4, outer portion 60 and inner element 64 interlock so that upper and lower flanges 67 and 68 of element 64 nest within recesses 69 and 70, formed perpendicular to U-shaped opening 72 in outer lid member 60. Correspondingly interlocking element 64 has a similar U-shaped opening 74 in leg section 76. As particularly shown in phantom, projection or leg portion 76, nest in outer cover section 60 to approximately the same depth or thickness so that projection 76 registers with U-shaped opening 72. U-shaped openings 72 and 74 in lid portions 60 and 64 are most preferably at right angles to U-shaped openings 46 and 56 in box bottom 44 and end closure member 50. As noted above, when such lid elements are formed so that their assembled width is equal to the width of box member 42, inner lid pieces 66 and 64 are retained in their assembled positions by outer pieces 60 and 62 and by adjacent pipes 14 which are not enclosed by the cover assembly.

Figure 6:
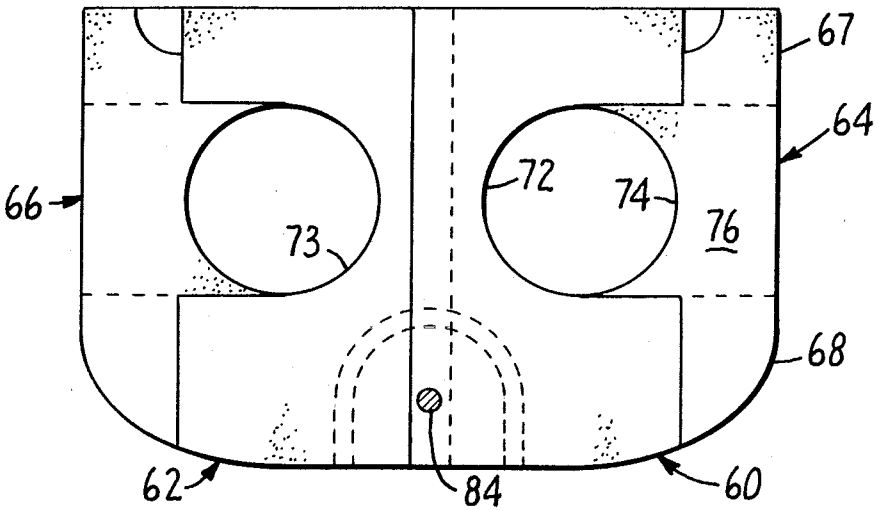
FIG. 6 is a plan view taken in the direction of arrows 6—6 in FIG. 5 illustrating the internal surface of the lid assembly, and shows the interlocking or nesting of the two parts.

As further indicated in FIG. 4, the assembly of lid member 61, including outer cover elements 60 and 62 and their interlocking inner elements 64 and 66, respectively, are secured to the box member by means of bolt 84 and nut 83. For assembly of the lid members around steam pipes 14, outer members 60 and 62 may be individually slipped over the steam pipes with their U-shaped openings 72 and 73 at 90 degrees to U-shaped openings 46 and 56 in the box member and end closure. Interlocking elements 64 and 66 are then nested in the position shown in FIG. 6 and indicated in phantom in FIG. 4. With flange 80 of element 62 abutting flange 82 of element 60, the cover or lid assembly is then seated over the other face of yoke 24 and hanger 20 and against the open edges of box member 44 by axially sliding the lid assembly along the pipes. The lid is then secured to box 44 by inserting bolt 84 through aligned bore 49 in box 44 and holes 71 and 73 in lid members 60 and 62. As indicated, both bores are formed with countersunk portions 51 in box member 44, and 75 in cover or lid assembly 60. In this way, nut 83 and bolt 84 may be covered with ceramic material 90 after assembly.

As also indicated in the exploded view of FIG. 4, relief holes 90 in bottom 44 accomodate rivets or bolts 26 securing yoke 24 to hanger 20. Similarly, quarter-circular notches 93 in lid inner pieces 64 and 66 accomodate the heads of such rivets or bolts.

It will be noted that each of the outer surfaces of the complete assembly such as edges 41 and 43 of box member 44 and edges 85 and 86, of lid member 60 and 62 are chamfered or rounded rather than having sharp corners. This avoids thin projections on the cover assembly which would form potential hot spots in the furnace for interaction of furnace combustion gases with the yoke, hanger or cover assembly.

While the various cover elements disclosed herein may be made by casting, as by simply pouring an uncured mixture of insulating aggregate into a mold, they may also be formed by injection pressure molding or centrifugal casting. In this way the insulation material is made uniformly dense so that the cured product is resistant to fracture or breakage during assembly on the steam pipes and supports, or potential development of stress fractures when exposed to heat and corrosive conditions by furnace combustion products. The preferred materials of construction of such insulating and refractory cover assemblies is a material comprising at least about 60% alumina and an insulating aggregate with a high purity binder. One such ceramic material which has been found quite suitable is known as "KAST-O-LITE 30" which is available from A. P. Green Retractories Co. of Mexico, Mo. Other materials from the same source, suitable for casting or pressure injection, are designated as "KS-4V" and "Mizzou Castable". Such materials are particularly characterized by their permanent volume after casting or forming and their resistance to temperatures in the range of 2400° to 3000° F. They are also resistant to corrosion in the presence of carbon monoxide atmospheres. Additionally, they have substantial resistance to vitrification, an embrittlement characteristic of such materials when stressed by thermal expansion and contraction in furnace service.

It will be apparent that the present cover assembly may be made to cover a single support for a single steam pipe suspended radially inwardly from a cylindrical furnace. For such purpose, it is necessary to use only one-half of the dual pipe yoke and hanger cover assembly of the illustrated and described embodiment. The cover box is accordingly cut parallel to the axial direction of the pipes and the single bolt and nut securing means relocated laterally from the position shown in FIG. 4.

Various other modifications and changes in the structure of the yoke and hanger cover will occur to those skilled in the art. All such modifications and changes coming within the scope of the claims are intended to be included.

I claim:

1. In a steam generator furnace having a generally cylindrical housing forming a conduction heating section, a multiplicity of steam tubes substantially equally spaced apart around the inner circumferential surface of said cylindrical housing and extending axially therethrough, each of said tubes being radially displaced from the surface of said housing by tube hanger means supported by said inner circumferential surface, yoke means overlying said steam tubes and means securing said yoke means to said hanger means with at least one of said steam tubes enclosed for support thereby, a replaceable refractory cover member enclosing said yoke and at least a portion of said hanger means for installation or removal therefrom without disassembly of said steam tubes from support in said housing by said yoke and hanger means which comprises:

a box member open at the top and one end, the base of said box member including at least one U-shaped opening to frictionally engage one of said tube members to permit said base to abut one side of both said yoke and said portion of said hanger, the sides of said box member extending axially along said tube member and beyond the axial thickness of said yoke and hanger means, a lid member for enclosing said box member top comprising a pair of nesting elements, each element having a U-shaped opening for slidably engaging a steam tube on the opposite side of said yoke and hanger members, each of said U-shaped openings surrounding diametrically opposed portions of said steam tube and both of said U-shaped openings being at right angles to said box member U-shaped opening, an end closure member nestable between said open end and said base of said box member to overlie said one side of said yoke and hanger means, said closure member having a U-shaped opening therein slidably engagable with said U-shaped opening in said box member to surround the diametrically opposed portion of said steam tube to complete the enclosure of said tube yoke and at least a portion of said hanger and the portion of said steam tube extending therethrough, and means for securing one of said pair of lid elements to said box member to clamp said end closure and the other of said pair of lid elements therebetween.

2. A replacable refractory cover member in accordance with claim 1 wherein said box member includes a pair of parallel U-shaped openings formed in said base for engaging a pair of adjacent furnace tubes supported by a single yoke.

3. A replacable refractory cover member in accordance with claim 2 wherein said lid member includes two pairs of said nesting lid elements.

4. A retrofit corrosion resistant cover member for assembly around a yoke and hanger support arrangement for a steam pipe extending therethrough without disassembly of said steam pipe from said support arrangement which comprises a box member having at least one U-shaped opening extending across the bottom of said box for slidable engagement with a semi-circumference of said steam pipe, the sides of said box member extending axially along said steam pipe to overlie both side edges of said yoke and hanger support arrangement and the inner surface of said box bottom being adapted to overlie at least one side of said support yoke, an end closure member having a U-shaped opening formed in a portion thereof, said portion being nestable within said U-shaped opening in said box member and including locking tabs adapted to mate with slots formed in said box bottom whereby said U-shape openings in said end closure and said bottom mutually surround said steam pipe, a lid assembly for covering the other side of said yoke and enclosing a portion of said pipe supported thereby, said assembly including an outer portion having a U-shaped opening at substantially a right angle to said U-shaped opening in said box member and an interlocking element having a projection including a U-shaped opening therein, said projection being adapted to nest within said U-shaped opening in said outer portion to encircle said steam pipe therebetween and means for securing said lid assembly to said box member to enclose said pipe yoke and at least a portion of said hanger supporting said yoke.

5. A retrofit corrosion resistant cover member in accordance with claim 4 wherein said box member includes a pair of parallel U-shaped openings formed in said box bottom for engaging a pair of adjacent steam pipes.

6. A retrofit corrosion resistant cover member in accordance with claim 5 wherein said lid assembly includes two pairs of said nesting elements, each pair covering one of said adjacent steam pipes.

7. A method of thermally insulating each of a plurality of yoke and hanger assemblies for individually supporting at least one of a multiplicity of steam tubes substantially equally spaced apart around the inner cylindrical surface of, and extending axially through, a steam generator housing, each of said tubes being radially displaced from said inner surface of said housing by one of said yoke and hanger assemblies, which comprises forming a replaceable refractory cover member to enclose said yoke and at least a portion of said hanger for installation or removal therefrom without disassembly of said steam tube from support by said housing, said replaceable refractory cover including a box member having an open top and one end, with the base of said box member including at least one U-shaped opening formed therein, then frictionally engage said U-shaped opening in said base with one of said tubes by pressing said base over said tube radially outwardly relative to said housing and laterally away from said yoke and hanger, radially inwardly relative to said housing pressing an end closure member over said pipe between said base and said yoke, said end closure being formed to nest in said base and having a U-shaped opening to conform with said tube and a body portion slidably engageable with said U-shaped opening in said base so that said base and end closure U-shaped openings surround diametrically opposed portions of said steam tube, then axially moving said base and end closure to about one side of both said yoke and at least a portion of said hanger so that the sides of said box member extending radially along said tube member and beyond the axial thickness of said yoke and hanger, forming a lid member to enclose said box member around said yoke as a pair of nesting elements, each element having a body section with a U-shaped opening therein for slidably engaging a steam tube on the opposite side of said yoke and hanger members, each of said body sections being mutually nestable so that said U-shaped openings surround diametrically opposed portions of said steam tube with both of said U-shaped openings at right angles to said box member U-shaped opening, said lid elements being installed over said tube by sliding said U-shaped openings circumferentially relative to said housing over said tube from opposite sides thereof and axially away from said yoke, then axially sliding said assembled lid elements along said tube into contact with said yoke and the open edges of said box member, and securing said lid elements to said box member to clamp said end closure and said pair of lid elements therebetween.

* * * * *

UNITED STATES PATENT AND TRADEMARK OFFICE

CERTIFICATE OF CORRECTION

PATENT NO. : 4,550,690

DATED : November 5, 1985

INVENTOR(S) : Stuart W. Baugher

It is certified that error appears in the above-identified patent and that said Letters Patent is hereby corrected as shown below:

Column 2, line 51, "wall" should be --shell--.
Column 3, line 5, "zone" should be --none--.
Column 7, line 1, after "correspondingly" a comma was omitted.
Column 7, line 4, "nest" should be --nests--.
Column 7, line 39, "90" should be --92--.
Column 10, line 33, "about" should be --abut--.
Column 10, line 35, "radially" should be --axially--.

Signed and Sealed this

Twenty-third Day of December, 1986

*Attest:*

DONALD J. QUIGG

*Attesting Officer* *Commissioner of Patents and Trademarks*